US007677051B2

(12) United States Patent
von Borstel

(10) Patent No.: US 7,677,051 B2
(45) Date of Patent: Mar. 16, 2010

(54) COMPRESSOR LUBRICATION

(75) Inventor: Steven E. von Borstel, Preble, NY (US)

(73) Assignee: Carrier Corporation, Farmington, CT (US)

( * ) Notice: Subject to any disclaimer, the term of this patent is extended or adjusted under 35 U.S.C. 154(b) by 936 days.

(21) Appl. No.: 10/848,190

(22) Filed: May 18, 2004

(65) Prior Publication Data

US 2005/0257542 A1 Nov. 24, 2005

(51) Int. Cl.
*F25B 31/00* (2006.01)

(52) U.S. Cl. ..... 62/192; 62/193; 62/468; 417/218

(58) Field of Classification Search ..... 62/84, 62/193, 468, 192, 470; 417/281
See application file for complete search history.

(56) References Cited

U.S. PATENT DOCUMENTS

| | | | | | |
|---|---|---|---|---|---|
| 3,280,576 | A | * | 10/1966 | Endress | 62/84 |
| 3,500,962 | A | * | 3/1970 | Kocher | 184/103.1 |
| 4,497,185 | A | * | 2/1985 | Shaw | 62/468 |
| 4,966,013 | A | * | 10/1990 | Wood | 62/193 |
| 5,134,856 | A | * | 8/1992 | Pillis et al. | 62/193 |
| 5,211,026 | A | * | 5/1993 | Linnert | 62/175 |
| 5,347,821 | A | * | 9/1994 | Oltman et al. | 62/84 |
| 6,041,605 | A | * | 3/2000 | Heinrichs | 62/84 |
| 6,134,898 | A | * | 10/2000 | Umemura et al. | 62/193 |

FOREIGN PATENT DOCUMENTS

| | | | |
|---|---|---|---|
| JP | 58-122390 | A | 7/1983 |
| JP | 60-216092 | A | 10/1985 |
| JP | 61-200486 | U | 12/1986 |
| JP | 6-108982 | A | 4/1994 |
| JP | 10-196575 | A | 7/1998 |

OTHER PUBLICATIONS

JP Office action for JP Patent Application No. 2007-527252, dated Sep. 1, 2009.

* cited by examiner

*Primary Examiner*—Marc E Norman
(74) *Attorney, Agent, or Firm*—Bachman & LaPointe, P.C.

(57) ABSTRACT

A system has a compressor having a compression path between a suction port located to receive a working fluid and a discharge port located to discharge the working fluid. The system has means for controlling a flow of at least one of additional working fluid and lubricant responsive to changes in at least one pressure parameter.

34 Claims, 3 Drawing Sheets

COMPRESSOR LUBRICATION

BACKGROUND OF THE INVENTION (1) Field of the Invention

The invention relates to compressors, and more particularly to screw-type compressors.

(2) Description of the Related Art

Screw-type compressors are commonly used in air conditioning and refrigeration applications. In such a compressor, intermeshed male and female lobed rotors or screws are rotated about their axes to pump the working fluid (refrigerant) from a low pressure inlet end to a high pressure outlet end. During rotation, sequential lobes of the male rotor serve as pistons driving refrigerant downstream and compressing it within the space between an adjacent pair of female rotor lobes and the housing. Likewise sequential lobes of the female rotor produce compression of refrigerant within a space between an adjacent pair of male rotor lobes and the housing. The interlobe spaces of the male and female rotors in which compression occurs form compression pockets (alternatively described as male and female portions of a common compression pocket joined at a mesh zone). In one implementation, the male rotor is coaxial with an electric driving motor and is supported by bearings on inlet and outlet sides of its lobed working portion. There may be multiple female rotors engaged to a given male rotor or vice versa.

When one of the interlobe spaces is exposed to an inlet port, the refrigerant enters the space essentially at suction pressure. As the rotors continues to rotate, at some point during the rotation the space is no longer in communication with the inlet port and the flow of refrigerant to the space is cut off. After the inlet port is closed, the refrigerant is compressed as the rotors continue to rotate. At some point during the rotation, each space intersects the associated outlet port and the closed compression process terminates. The inlet port and the outlet port may each be radial, axial, or a hybrid combination of an axial port and a radial port.

As the refrigerant is compressed along a compression path between the inlet and outlet ports, sealing between the rotors and between the rotors and housing is desirable for efficient operation. Compressor lubrication and cooling may also be important for compressor life and efficiency. Lubricant (e.g., oil) may be introduced to lubricate bearings and/or the rotors and housing. The oil may also provide levels of sealing and cooling. All or a portion of the oil may become entrained in the refrigerant and may be recovered downstream of the compressor.

SUMMARY OF THE INVENTION

One aspect of the invention involves a system having a compressor with a compression path between a suction port located to receive a working fluid and a discharge port located to discharge the working fluid. The system includes means for controlling a flow of at least one of additional working fluid and lubricant responsive to changes in at least one pressure parameter.

In various implementations, a condenser may receive and condense working fluid compressed by the compressor. An evaporator may receive and evaporate working fluid condensed by the condenser and return the evaporated working fluid to the compressor. The parameter may comprise a difference between a discharge pressure and a second pressure. The means may comprise a pressure-actuated mechanical valve or an electronically-controlled electric valve.

Another aspect of the invention involves an apparatus having a male rotor with a screw type male body portion and extending from a first end to a second end and held within the housing assembly for rotation about a first rotor axis. A female rotor has a screw type female body portion enmeshed with the male body portion and extending from a first end to a second end and held within the housing assembly for rotation about a second rotor axis. The rotors and housing cooperate to define at least one compression path. A lubrication system has a source of pressurized lubricant, a conduit coupled to the source and the housing, and a one-way pressure-actuated valve in the conduit.

In various implementations, the conduit may be coupled to the housing to introduce lubricant at a location between a first tenth and a last tenth of the at least one compression path. A bearing may support at least one of the male and female rotors. The one-way pressure-actuated valve may be outside of a bearing lubricant flowpath from the source to the bearing. The one-way pressure-actuated valve may be outside a sealing lubricant flowpath from the source to a sealing chamber. The apparatus may be used in a cooling system wherein the lubricant source comprises a separator. A condenser may receive and condense refrigerant compressed by the apparatus. An evaporator may receive and evaporate the refrigerant condensed by the condenser and return the evaporated refrigerant to the apparatus.

Another aspect of the invention involves a compressor system for compressing a working fluid to drive the working fluid along a flowpath. A housing assembly contains enmeshed male and female rotors respectively having male and female screw type body portions. The system includes means for lubricating the compressor system responsive to at least one of: an at least partial obstruction of the flowpath; and a loss of the working fluid.

In various implementations, the housing may cooperate with the rotors to define inlet and outlet chambers. The male rotor may rotate in a first direction about its axis and the female rotor may rotate in an opposite second direction about its axis. The means may be coupled to the housing between the inlet and outlet chambers. The means may include a one-way pressure-actuated valve positioned to pass lubricant to a first location in the compressor responsive to a pressure drop at the first location. The one-way pressure-actuated valve may be positioned outside a bearing lubrication flowpath from a lubricant source to a bearing.

Another aspect of the invention involves a method including operating a compressor having enmeshed first and second elements so as to compress a working fluid and drive the working fluid along a recirculating flowpath. Responsive to a pressure drop at a first location along the flowpath, a lubricant is introduced to the compressor.

In various implementations, the pressure drop may result from an obstruction in the flowpath. The pressure drop may result from a loss of the working fluid. The introduction may be at the first location. The first location may be proximate a last closed lobe location. The introduction may be automatic resulting from action of a pressure differential between the first location and a second location in the lubrication system. The introduction may result from action of the pressure differential across a one-way valve. The compressor may have a housing assembly and male and female rotors may have enmeshed male and female body portions.

Another aspect of the invention involves a method including operating a compressor having enmeshed first and second elements so as to compress a working fluid and drive the working fluid along a recirculating flowpath. Responsive to an obstruction in the flowpath, a lubricant or coolant is introduced to the compressor.

In various implementations, the introduction may be responsive to a pressure drop at a first location along the flowpath resulting from the obstruction. The introduction may be at the first location.

The details of one or more embodiments of the invention are set forth in the accompanying drawings and the description below. Other features, objects, and advantages of the invention will be apparent from the description and drawings, and from the claims.

BRIEF DESCRIPTION OF THE DRAWINGS

Like reference numbers and designations in the various drawings indicate like elements.

DETAILED DESCRIPTION

Figure 1:
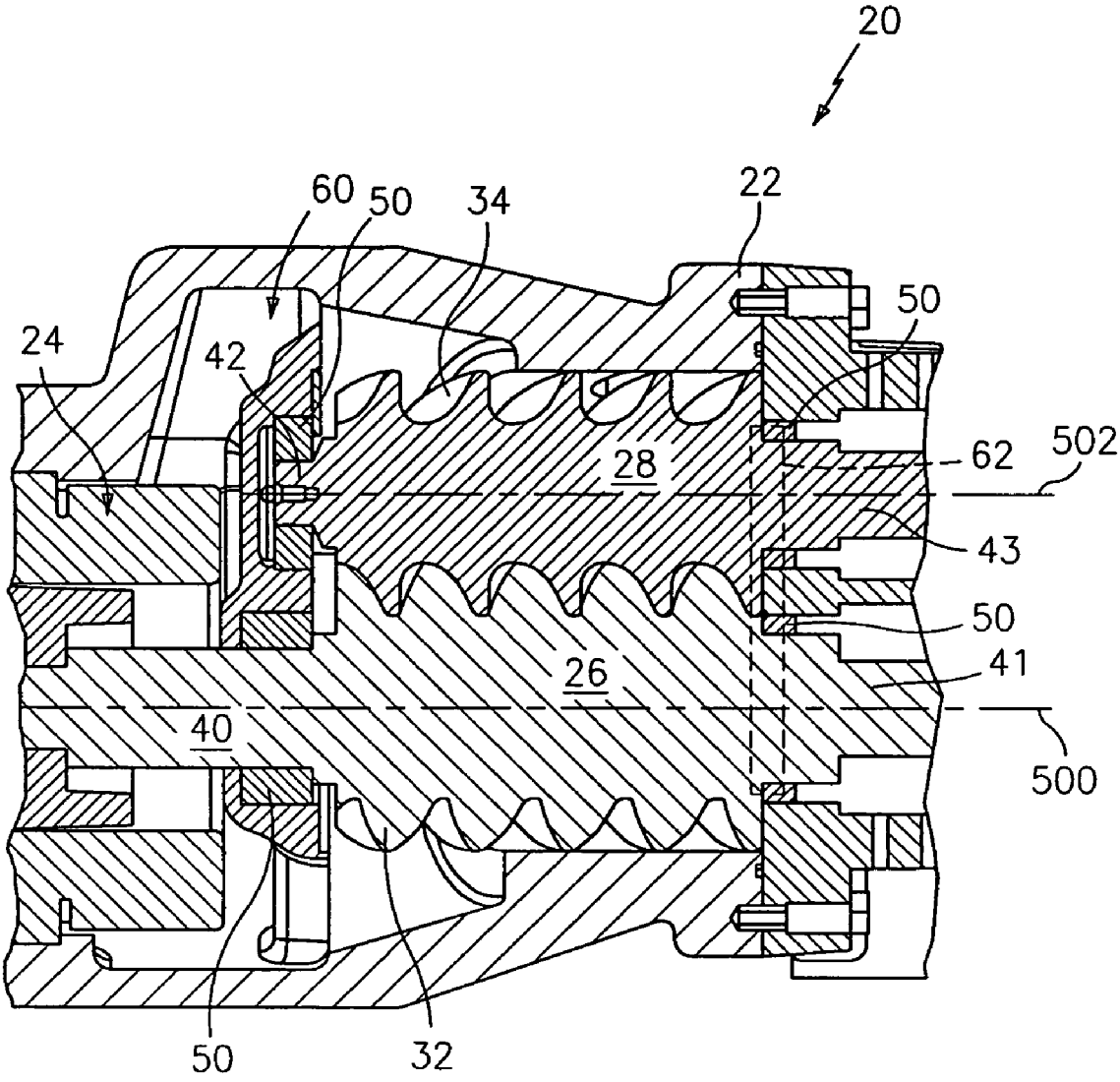
FIG. 1 is a partial semi-schematic longitudinal cutaway sectional view of a compressor.

FIG. 1 shows a compressor 20 having a housing assembly 22 containing a motor 24 driving rotors 26 and 28 having respective central longitudinal axes 500 and 502. In the exemplary embodiment, the male rotor 26 is centrally positioned within the compressor and has a male lobed body or working portion 32 enmeshed with female lobed body or working portion 34 of the female rotor 28. Each rotor includes shaft portions (e.g., stubs 40, 41, and 42, 43 unitarily formed with the associated working portion 32 and 34) extending from first and second ends of the working portion. Each of these shaft stubs is mounted to the housing by one or more bearing assemblies 50 for rotation about the associated rotor axis.

In the exemplary embodiment, the motor 24 is an electric motor having a rotor and a stator. A portion of the first shaft stub 40 of the male rotor 26 extends within the stator and is secured thereto so as to permit the motor 24 to drive the male rotor 26 about the axis 500. When so driven in an operative first direction about the axis 500, the male rotor drives the female rotor in an opposite direction about its axis 502. The resulting enmeshed rotation of the rotor working portions tends to drive fluid from a first (inlet) end plenum 60 to a second (outlet) end plenum 62 (shown schematically) while compressing such fluid. This flow defines downstream and upstream directions.

Surfaces of the housing combine with the rotors to define respective inlet and outlet ports to a compression pocket. In each pocket (e.g., two if a second female rotor were provided in a three-rotor design), one portion is located between a pair of adjacent lobes of each rotor. Depending on the implementation, the ports may be radial, axial, or a hybrid of the two.

Figure 2:
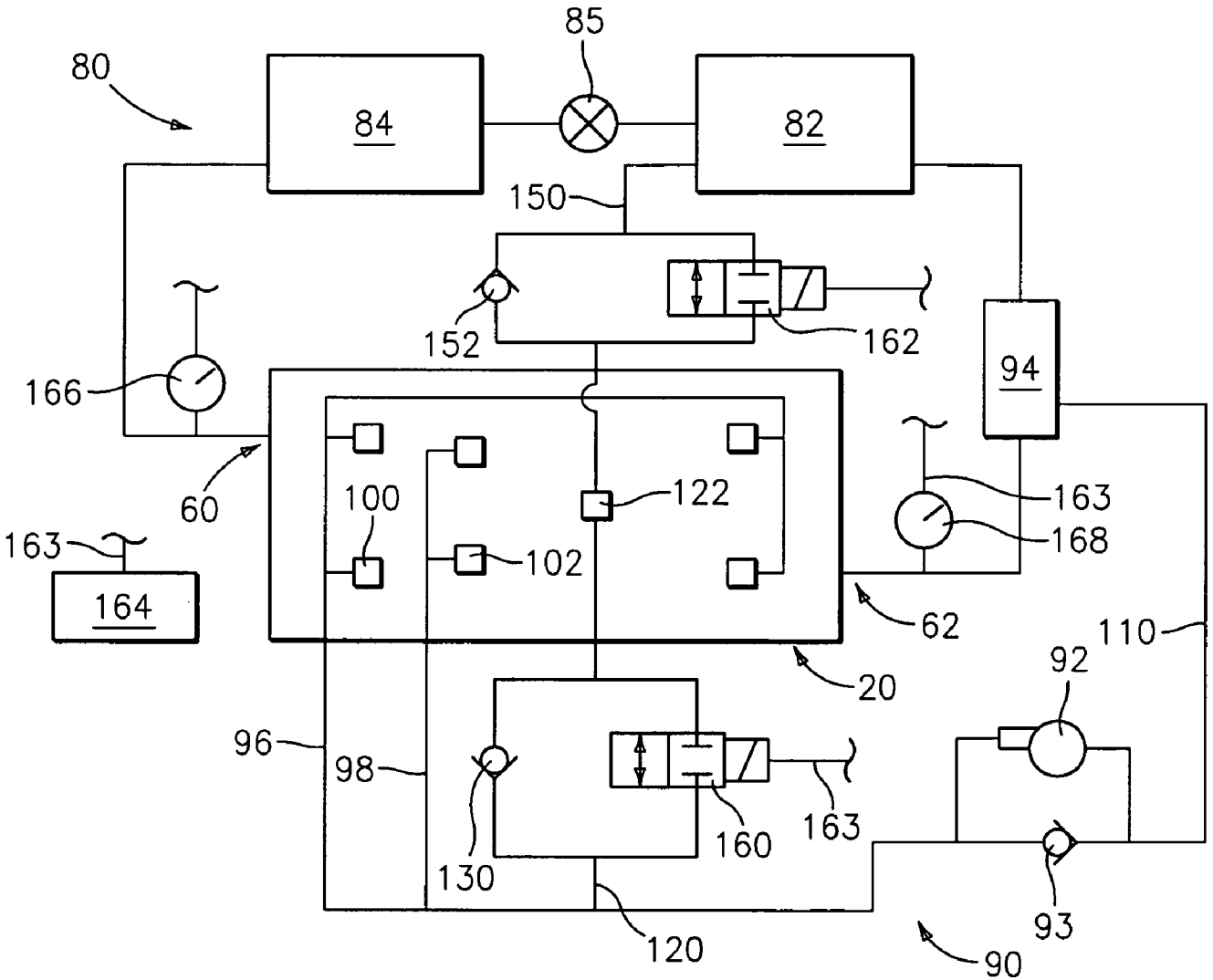
FIG. 2 is a schematic view of a cooling system including the compressor of FIG. 1.

FIG. 2 schematically shows the compressor 20 in a system 80. The basic system 80 includes a condenser 82 downstream of the compressor outlet plenum 62 and an evaporator 84 downstream of the condenser 82 and upstream of the compressor inlet plenum 60 along a recirculating refrigerant flowpath. A throttle valve 85 (e.g., an electronic expansion valve) is located between the condenser and evaporator. The basic refrigerant flowpath is essentially a closed single loop flowpath. More complex branching flowpaths may be used for more complex systems, including the use of economizer units and the like.

The exemplary system 80 includes a lubrication system 90. The lubrication system includes a lubricant source such a separator/reservoir 94 between the compressor and condenser. The source may further include a pump 92 drawing lubricant from the reservoir and/or a one-way check valve 93. A lubricant flowpath from the source may include flowpath branches defined by conduit branches 96 and 98 for delivering lubricant (e.g., oil) for bearing lubrication and sealing purposes, respectively, as is known in the art or may yet be developed. In the exemplary embodiment, the conduit branch 96 directs oil to compartments 100 containing the bearings 50 for lubricating the bearings. The conduit branch 98 directs oil to compartments (chambers) 102 for rotor sealing and cooling. Oil may entrained in the refrigerant flow will be separated/recovered therefrom by the separator/reservoir 94. An exemplary oil separationlrecovery system is provided in the separator 94 which directs a recovered oil flow back to the compressor via an oil return conduit/line 110. Other variations may be possible. Additional oil return lines from the compressor may return portions of the oil delivered to the compressor (e.g., from the bearing compartments).

A restriction in the refrigerant flow (e.g., from a partial blockage outside of the compressor) may cause a pressure drop somewhere downstream thereof and/or a pressure increase somewhere upstream thereof. The exact nature of the pressure changes will depend on a number of factors including: the location and nature of the restriction; the type of compressor; the configuration of the system; and the properties of the refrigerant.

Figure 3:
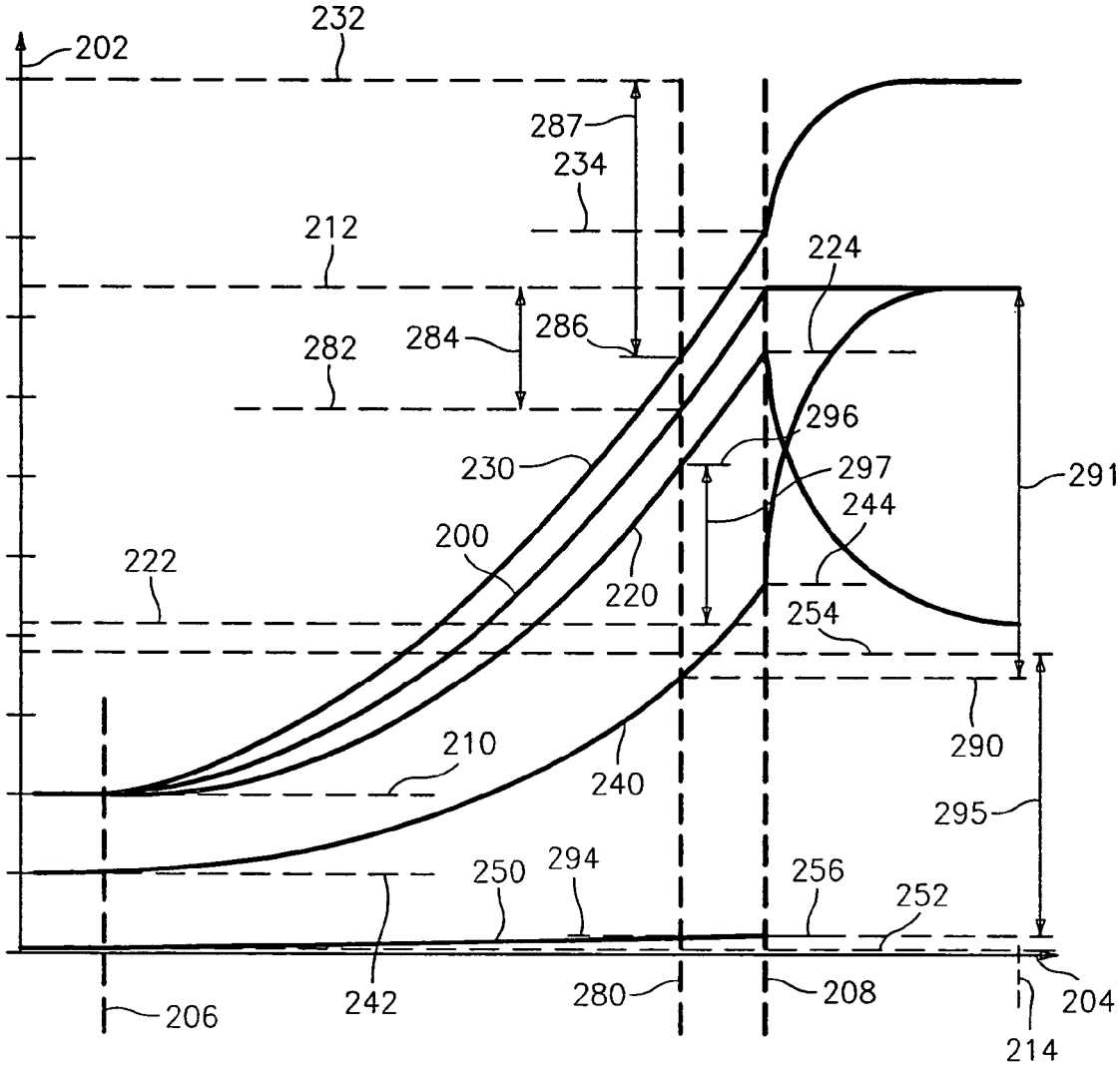
FIG. 3 is a graph of pressure against compression pocket volume for the compressor of FIG. 1.

In a neutral condition, the pressure ratio (discharge pressure divided by suction pressure) is essentially equal to the volume index of the compressor. FIG. 3 shows a neutral condition plot 200 of pressure 202 against location 204 within the compressor. The identified location may serve as a proxy for the stage of compression or for time within the compression cycle. The location 204 may run from high volume to low volume, with a maximum volume 206 at the closing of the pocket (the first closed lobe position) and a smaller volume 208 at the opening of the pocket to discharge. In an exemplary embodiment, this opening may be coincident with the last closed lobe position. In alternative embodiments, the opening may be slightly after the last closed lobe position. Pressure values 210 and 212 identify the suction and discharge pressures. In the ideal condition, the discharge pressure is a peak pressure which substantially continues through the discharge process (until position/time 214).

FIG. 3 further shows a plot 220 of a normal overcompressed condition wherein the pressure ratio is less than the volume index of the compressor. This may be a transient or a longer duration condition. A change in system condition has dropped the discharge pressure 222 below the discharge pressure 212 while leaving suction pressure unchanged. A peak pressure 224 occurs at the last closed lobe position 208, whereafter the pressure drops sharply to the reduced discharge pressure 222. FIG. 3 shows the pressure 224 at the last closed lobe position 208 as being slightly less than the normal pressure at this location (essentially the normal discharge pressure 212). This decrease, and proportional slight decrease throughout the range between first and last closed lobe positions may result from a difference in leakage (e.g., at the discharge port). Absent leakage, the plots 220 and 200 would be coincident over this range. Such a system condition may, for example, result from a drop in saturated condensing temperature or discharge temperature.

FIG. 3 further shows a plot 230 of a normal undercompressed condition wherein the pressure ratio is greater than the volume index of the compressor. A change in system condition has raised the discharge pressure to an elevated level 232 while leaving the suction pressure substantially unaffected. At the last closed lobe position 208, the pressure 234 is below the discharge pressure 232. Upon opening of the compression pocket at the end of the compression stage and beginning of the discharge stage, the pressure rises to the discharge pressure 232. As in the overcompressed condition of plot 220, a difference in leakage may cause the plot 230 to depart from the normal plot 220 between positions 206 and 208, slightly elevating the pressure 234 above the discharge pressure 212. Such a system condition may, for example, result from an increase in saturated condensing temperature or discharge temperature.

Other changes in system condition may involve changes to suction pressure with discharge pressure substantially unaffected. Yet other changes in system condition may affect both suction pressure and discharge pressure.

FIG. 3 further shows a plot 240 of an alternate undercompressed condition wherein the suction pressure 242 is reduced but the discharge pressure is unaffected. At the last closed lobe position, the pressure 244 is below the discharge pressure. Upon opening, the pressure rises to the discharge pressure 212. Such a system condition may, for example, result from reduced saturated suction temperature.

Other overcompressed or undercompressed conditions may be outside a normal domain and may be caused by abnormal physical conditions of the system such as blockages, leaks, control failures, and other causes. FIG. 3 further shows a plot 250 of an extreme undercompressed condition wherein the pressure ratio is hugely greater than the volume index of the compressor. The suction pressure 252 has dropped to near zero and the discharge pressure 254 has also substantially dropped (although proportionally not as much). Although the pressure 256 at the last closed lobe position 208 may represent an increase over the suction pressure 252 consistent with the volume index of the compressor, the low absolute value of the suction pressure leaves the last closed lobe pressure substantially lower than even the abnormally low discharge pressure 254. Upon opening, the pressure sharply rises to the discharge pressure 254. Such an abnormal system condition may, for example, result from a loss of refrigerant or a blockage (e.g., somewhere upstream of the suction port and downstream of the condenser).

An abnormal system condition may decrease suction pressure and reduce refrigerant flow through the compressor. The resulting increased pressure ratio may increase heating of the compressor components. Also, the decreased refrigerant flow reduces cooling of the compressor via heat transfer to the refrigerant. The resulting heating-induced differential thermal expansion of the compressor components may adversely influence tolerances. There may be increased loaded contact or interference between relatively moving parts (e.g., the rotors relative to each other and/or to the housing) causing further frictional heating in a potentially destructive cycle resulting in wear and/or failure.

According to one aspect of the invention, additional lubricant (e.g., oil) and/or additional working fluid (e.g., additional refrigerant) may be introduced to the compressor responsive to an abnormal situation such as a refrigerant obstruction or pressure changes still within a normal operational domain. The additional oil/fluid may be strategically introduced for lubrication and/or cooling of the working elements to maintain proper interaction of the elements with each other and/or with the housing to prevent/resist failure. For example, the additional lubricant may reduce heat via direct heat transfer from the compressor hardware to the lubricant.

One or more lubricant lines 120 extend from the lubricant source output to one or more ports 122 on the compressor. The port(s) 122 may be positioned on the compressor housing to introduce the oil/fluid during the compression process. An exemplary port may be exposed to the compression pocket after the suction stage (the first closed lobe position) and before the discharge stage. More particularly, the oil/fluid may be introduced late in the compression process (e.g., through a port exposed to the compression pocket only late in the compression process). In nomial operation, the pressure at this location will be close to the discharge plenum pressure. An exemplary location may be after the middle of the compression process or in the last third or quarter of the process. It may be slightly before the end of the compression process (e.g., before the last fiftieth, twentieth, or tenth). For example, if between the middle and the last fiftieth of the at least one compression path, in a simple embodiment the location is exposed to the compression pocket only after half of the compression process and at least before the last fiftieth of the compression process.

In an exemplary implementation, oil is introduced to this location only in response to an abnormal event. Other variations might have a baseline oil flow with an additional flow amount being introduced responsive to such event. In the exemplary embodiment, a one-way pressure-actuated valve 130 is positioned in the line 120. However, multiple such valves may be associated with multiple such lines (e.g., if there are multiple different locations). The valve 130 has two advantageous properties. It may act as a check valve only permitting flow from the source to the introduction location but not flow in the opposite direction. It may also permit flow in such a downstream direction only responsive to a certain pressure differential. For example, in normal operation, the pump 92 may have a normal range of discharge pressures. Similarly, the compressor may have a normal pressure or range of pressures at the introduction location.

FIG. 3 shows a location 280 of the port(s) 122 somewhat ahead of the last closed lobe position 208. In the normal condition, the pressure at this location is shown as 282 which is below the normal discharge pressure by an amount 284. In the exemplary system of FIG. 2, the separator/reservoir 94 operates at the discharge pressure so changes in the discharge pressure may effect changes in oil pressure. The bias of the valve 130 is selected so that, within a normal range of the difference 284 between the pump outlet pressure and the pressure at the introduction location 280, there is no downstream flow of oil through the line 120. However, once the pressure difference across the valve 130 exceeds a threshold (e.g., the pressure at the introduction location drops below the discharge pressure by a threshold amount (e.g., a given amount greater than the expected maximum normal difference 284)), the valve 130 opens to permit the supplemental oil flow. In the exemplary implementation, the valve 130 is essentially a binary valve, either fully open or fully closed. However, it may alternatively have a range of restriction (e.g., proportional to the pressure difference).

By way of example, an exemplary system using R-134A refrigerant may have an ideal normal saturated suction temperature of 42 F and saturated discharge temperature of 130 F. The suction pressure 210 may be 50 psia and the discharge pressure 212 may be 210 psia. The ports 122 may be positioned so that the normal pressure 282 at the location 280 is 180 psia for a normal difference 284 of 30 psi. The bias of the valve 130 may be selected, in view of the properties of the valve 93 and pump 92, to open if the difference 284 exceeds 40 psi.

In the exemplary undercompressed condition of plot 230, the saturated suction temperature may be 42 F and the saturated discharge temperature may be 150 F. The suction pressure 210 may be 50 psia and the discharge pressure 232 may be 275 psia, the port pressure 286 may be 195 psia for a difference 287 of 80 psi. As this is sufficient to overcome the 40 psi threshold, oil will flow through the line 120 and into the compressor to provide further cooling.

In the exemplary undercompressed condition of plot 240, the saturated suction temperature may be 5 F and the saturated discharge temperature may be 130 F. The suction pressure 242 may be 25 psia and the discharge pressure 212 may be 210 psia. The pressure 290 at the location 280 may be 90 psia for a difference 291 of 120 psi. Again, this difference is sufficient to permit the supplemental oil flow through the line 120.

In the undercompressed condition of plot 250, the saturated suction temperature may be −45 F and the saturated discharge temperature may be 72 F. The suction pressure 252 may be less than 5 psia and the discharge pressure 254 may be 95 psia. The pressure 294 at location 280 may be 90 psia and the difference 295 may be 120 psi. This difference is sufficient to permit the supplemental lubricant flow.

In the overcompressed condition of plot 220, however, the saturated suction temperature may be 42 F and the saturated discharged temperature may be 85 F. The suction pressure 210 may be 50 psia and the discharge pressure 222 may be 105 psia. The pressure 296 at the location 280 may be 160 psia. The pressure difference 297 may be −55 psi which does not permit the supplemental lubricant flow. In such a situation, the discharge to suction pressure ratio and difference are low enough to permit a high mass flow rate of refrigerant which keeps the compressor cool. Supplemental lubricant injection may be disadvantageous if it reduces the lubricant or lubricant pressure available for the main lubrication of the bearings.

Alternative embodiments may utilize a supplemental refrigerant flow instead of or in addition to a supplemental oil flow. FIG. 2 shows a line 150 from the condenser to the port 122. A check valve 152 is located in the line 150 and directs refrigerant to the port(s) 122 in a similar fashion to the direction of lubricant by the valve 130. Alternative implementations may use one or more electronically-actuated valves instead of or in addition to the valves 130 and 152. When used in addition, the electronically-controlled valves (e.g., solenoid valves) may be in parallel with the pressure-actuated valves. FIG. 2 shows a lubricant solenoid valve 160 and a refrigerant solenoid valve 162. The valves 160 and 162 may be electronically coupled to (e.g., via wiring 163) and controlled by a control system 164 in response to a pressure difference measured by pressure sensors 166 and 168 coupled to the control system. Upon a sensed pressure differential indicating an undesired undercompression condition, the valve 162 may be opened to permit refrigerant flow through the line 150 to the port(s) 122. This refrigerant flow will help cool the compressor. Alternatively or additionally, the valve 160 may be opened to permit lubricant flow through the line 120 to the port(s) 122.

A similar effect will occur when, additionally or alternatively to a blockage, there is a loss of refrigerant. The refrigerant loss may cause a similar pressure drop at the injection location.

One or more embodiments of the present invention have been described. Nevertheless, it will be understood that various modifications may be made without departing from the spirit and scope of the invention. For example, the principles may be applied to various existing and yet-developed compressor configurations and also applications (e.g., compressing of natural gas as a working fluid in an open system). Details of such configurations and applications may influence details of the associated implementations. Alternatively, the hardware and software may be configured so that the apparent default condition involves the flow of the otherwise supplemental lubricant or working fluid. In such a situation, a favorable pressure difference (indicating that such flow is not fully or partially required) may cause such flow to be fully or partially interrupted. Accordingly, other embodiments are within the scope of the following claims.

What is claimed is:

1. A system comprising:

a compressor having a compression path between a suction port located to receive a working fluid and a discharge port located to discharge the working fluid; and means for controlling a flow of at least one of additional working fluid and lubricant responsive to changes in at least one pressure parameter.

2. The system of claim 1 further comprising:

a condenser receiving and condensing working fluid compressed by the compressor; and an evaporator receiving and evaporating working fluid condensed by the condenser and returning the evaporated working fluid to the compressor.

3. The system of claim 1 wherein said parameter comprises a difference between a discharge pressure and a second pressure.

4. The system of claim 1 wherein said means comprises a pressure-actuated mechanical valve.

5. The system of claim 1 wherein said means is configured to introduce said at least one of additional working fluid and lubricant when a difference of a discharge location pressure above an introduction location pressure exceeds a normal operational threshold.

6. The system of claim 1 wherein said means is configured to introduce said lubricant supplemental to a baseline flow of lubricant and at least partially separate therefrom.

7. The system of claim 1 wherein said means is configured to introduce said additional working fluid when a difference of a discharge location pressure above an introduction location pressure exceeds a normal operational threshold.

8. An apparatus comprising:

a housing assembly;

a male rotor having a screw type male body portion, the male rotor extending from a first end to a second end and held within the housing assembly for rotation about a first rotor axis;

a female rotor having a screw type female body portion enmeshed with the male body portion, the female rotor extending from a first end to a second end and held within the housing assembly for rotation about a second rotor axis and cooperating with the male rotor and housing to define at least one compression path; and a lubrication system having:

a source of pressurized lubricant;

a conduit coupled to the source and the housing; and a one-way pressure-actuated valve in the conduit configured to open responsive to an abnormal pressure difference to admit additional lubricant to the housing through the conduit.

9. The apparatus of claim 8 wherein:

the conduit is coupled to the housing to introduce lubricant at a location between a first tenth and a last tenth of said at least one compression path.

10. The apparatus of claim 8 wherein:

a bearing supports at least one of the male and female rotors; and the one-way pressure-actuated valve is outside a bearing lubricant flowpath from the source to the bearing.

11. The apparatus of claim 8 wherein:

the one-way pressure-actuated valve is outside a sealing lubricant flowpath from the source to a sealing chamber.

12. The apparatus of claim 8 wherein the lubricant source comprises a separator, and further comprising:

a condenser receiving and condensing refrigerant compressed by the apparatus; and an evaporator receiving and evaporating the refrigerant condensed by the condenser and returning the evaporated refrigerant to the apparatus.

13. The apparatus of claim 8 wherein:

the conduit is coupled to the housing to introduce lubricant at a location in communication with the compression volume at a point where the volume has been compressed by between 10% and 90%.

14. The apparatus of claim 8 wherein:

the conduit is coupled to the housing to introduce lubricant at a location in communication with the compression volume at a point where the volume has been compressed by at least 50%.

15. The apparatus of claim 8 wherein:

the source comprises an oil separator; and the one-way pressure-actuated valve is positioned between the separator and the housing.

16. A compressor system for compressing a working fluid to drive the working fluid along a flowpath and comprising:

a housing assembly;

a male rotor having a screw type male body portion, the male rotor extending from a first end to a second end and held within the housing assembly for rotation about a first rotor axis;

a female rotor having a screw type female body portion enmeshed with the male body portion, the female rotor extending from a first end to a second end and held within the housing assembly for rotation about a second rotor axis; and means for lubricating the compressor system responsive to at least one of:

an at least partial obstruction of the flowpath; and a loss of the working fluid.

17. The compressor of claim 16 wherein the housing cooperates with the male and female rotors to define inlet and outlet chambers and the male rotor rotates in a first direction about the first axis and the female rotor rotates in an opposite second direction about the second axis, and the means is coupled to the housing between the inlet and outlet chambers.

18. The compressor of claim 16 wherein the means includes a one-way pressure-actuated valve positioned to pass lubricant to a first location in the compressor responsive to a pressure drop at said first location.

19. The compressor of claim 18 wherein the one-way pressure-actuated valve is positioned outside a bearing lubrication flowpath from a lubricant source to a bearing, the one-way pressure-actuated valve positioned between the lubricant source and the first location.

20. The compressor of claim 16 wherein the means is configured to introduce lubricant as a supplemental flow, supplementing a baseline lubricant flow and at least partially separate therefrom.

21. The compressor of claim 16 wherein the means comprises a valve having a valve bias.

22. A method comprising:

operating a compressor having enmeshed first and second elements so as to compress a working fluid and drive said working fluid along a recirculating flowpath; and wherein responsive to a pressure drop at a first location along the flowpath, a lubricant is introduced to the compressor through a one-way pressure-actuated valve.

23. The method of claim 22 wherein:

the pressure drop results from an obstruction in the flowpath.

24. The method of claim 22 wherein:

the pressure drop results from a loss of the working fluid.

25. The method of claim 22 wherein:

the introducing is at said first location.

26. The method of claim 25 wherein:

said first location is proximate a last closed lobe location.

27. The method of claim 22 wherein:

the step of introducing is automatic resulting from action of pressure differential between the first location and a second location in a lubrication system.

28. The method of claim 27 wherein:

the step of introducing results from action of said pressure differential across said valve.

29. The method of claim 22 performed with said compressor having:

a housing assembly;

a male rotor having a screw type male body portion, the male rotor extending from a first end to a second end and held within the housing assembly for rotation about a first rotor axis; and a female rotor having a screw type female body portion enmeshed with the male body portion, the female rotor extending from a first end to a second end and held within the housing assembly for rotation about a second rotor axis.

30. The method of claim 22 wherein:

the introducing is performed without shutting down the compressor.

31. A method comprising:

operating a compressor having enmeshed first and second elements so as to compress a working fluid and drive said working fluid along a recirculating flowpath; and wherein responsive to an obstruction in the flowpath, a coolant is introduced to the compressor through a one-way pressure-actuated valve.

32. The method of claim 31 wherein:

the step of introducing is responsive to a pressure drop at a first location along the flowpath resulting from the obstruction.

33. The method of claim 32 wherein:

the step of introducing is at said first location.

34. An apparatus comprising:

a housing assembly;

a male rotor having a screw type male body portion, the male rotor extending from a first end to a second end and held within the housing assembly for rotation about a first rotor axis;

a female rotor having a screw type female body portion enmeshed with the male body portion, the female rotor extending from a first end to a second end and held within the housing assembly for rotation about a second rotor axis and cooperating with the male rotor and housing to define at least one compression path; and a lubrication system having:

a source of pressurized lubricant, the source comprising an oil separator;

a conduit coupled to the source and the housing; and a one-way pressure-actuated valve in the conduit between the separator and the compression path and configured to open responsive to an abnormal pressure difference to admit additional lubricant to the housing through the conduit.

* * * * *